US006926085B1

(12) United States Patent
Schaefer, Jr.

(10) Patent No.: US 6,926,085 B1
(45) Date of Patent: Aug. 9, 2005

(54) SAFETY SYSTEM FOR UNDERWATER CUTTING

(76) Inventor: Louis E. Schaefer, Jr., 125 Bergeron Loop, Carencro, LA (US) 70520

( * ) Notice: Subject to any disclaimer, the term of this patent is extended or adjusted under 35 U.S.C. 154(b) by 70 days.

(21) Appl. No.: 10/624,091

(22) Filed: Jul. 21, 2003

Related U.S. Application Data

(60) Provisional application No. 60/397,510, filed on Jul. 19, 2002.

(51) Int. Cl.[7] ..... E21B 29/12
(52) U.S. Cl. ..... 166/361; 166/55; 166/298
(58) Field of Search ..... 166/361, 298, 166/55.7, 55.8, 55; 405/226

(56) References Cited

U.S. PATENT DOCUMENTS 3,848,667 A * 11/1974 Clark, Jr. ..... 166/55.6
3,938,600 A * 2/1976 Essmeier ..... 175/422
4,144,936 A * 3/1979 Evans ..... 166/298
4,619,556 A * 10/1986 Parra ..... 405/195
4,799,829 A * 1/1989 Kenny ..... 405/195
4,919,210 A 4/1990 Schaefer, Jr.
5,238,069 A 8/1993 Schaefer, Jr. et al.
5,259,458 A 11/1993 Schaefer, Jr. et al.

* cited by examiner

*Primary Examiner*—Hoang Dang
(74) *Attorney, Agent, or Firm*—Garvey, Smith, Nehrbass & Doody, L.L.C.; Seth M. Nehrbass

(57) ABSTRACT

Apparatus for a method of cutting pipes underwater comprising jetting a jacket down over the pipe, blowing mud out from between the pipe and the jacket so the annulus between the pipe and the jacket is substantially filled with water and/or air, and performing the cutting operation from within the pipe, wherein the jacket has the features mentioned herein.

3 Claims, 3 Drawing Sheets

SAFETY SYSTEM FOR UNDERWATER CUTTING

CROSS-REFERENCE TO RELATED APPLICATIONS

Priority of U.S. Provisional Patent Application Ser. No. 60/397,510, filed 19 Jul. 2002, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to underwater cutting devices. More particularly, the present invention relates to cutting pipes under water.

2. General Background of the Invention

The following U.S. patents are incorporated herein by reference:

U.S. Pat. Nos. 5,238,069; 5,259,458; 4,919,210.

U.S. Pat. No. 5,238,069 discloses an apparatus for cutting pipes underwater comprising a jacket, an external supply ring, means for jetting the jacket down over the pipe, and means for blowing mud out from between the pipe and the jacket so the annulus between the pipe and the jacket can be substantially filled with water and/or air, wherein the jacket includes jet tubes running from the external supply ring down the outside wall of the jacket.

BRIEF SUMMARY OF THE INVENTION

The present invention is an improvement to the device disclosed in U.S. Pat. No. 5,238,069.

The present invention includes an apparatus for cutting pipes underwater comprising a jacket, an external supply ring, means for jetting the jacket down over the pipe, and means for blowing mud out from between the pipe and the jacket so the annulus between the pipe and the jacket can be substantially filled with water and/or air, wherein the jacket includes jet tubes running from the external supply ring through the wall of the jacket and turn down on the inside of the jacket.

The present invention includes an apparatus for cutting pipes underwater comprising a jacket, means for jetting the jacket down over the pipe, and means for blowing mud out from between the pipe and the jacket so the annulus between the pipe and the jacket can be substantially filled with water and/or air, wherein the jacket includes jet pipes and a supply ring outfitted with air supply connections that allow for injecting air through the jet pipes to create a vacuum to pull the oxygen through the cut and up the annulus.

The present invention includes a method of cutting pipes underwater comprising jetting a jacket of the present invention down over the pipe, blowing mud out from between the pipe and the jacket so the annulus between the pipe and the jacket is substantially filled with water and/or air, and performing the cutting operation from within the pipe.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 5:
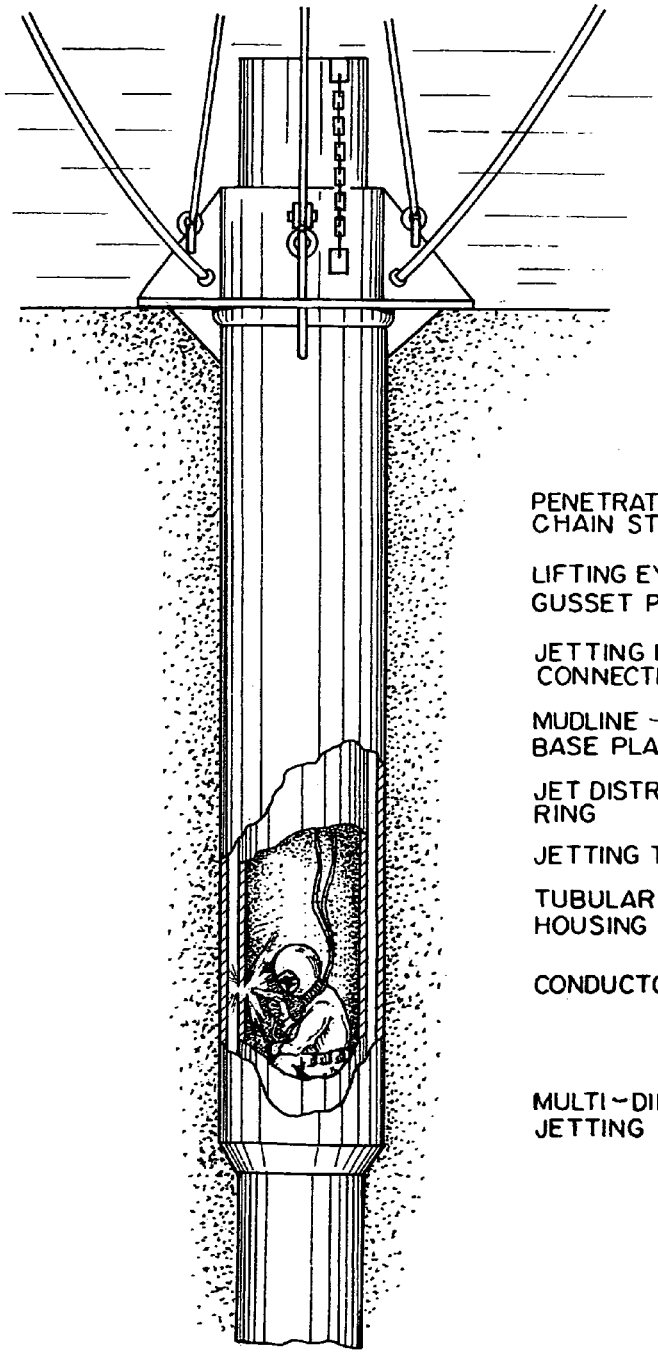
FIG. 5 (PRIOR ART)
FIG. 5 is a side view showing related prior art apparatus in use.
Figure 6:
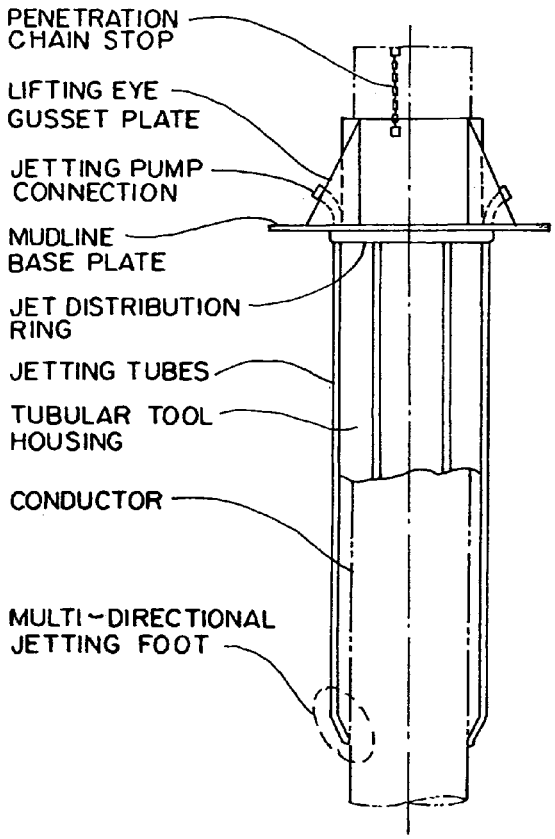
FIG. 6 (PRIOR ART)
FIG. 6 is a side, partially cutaway view showing related prior art apparatus.

The attached drawings (FIGS. 1–4) show the present invention and (FIGS. 5 and 6) prior related devices.

Figure 1:
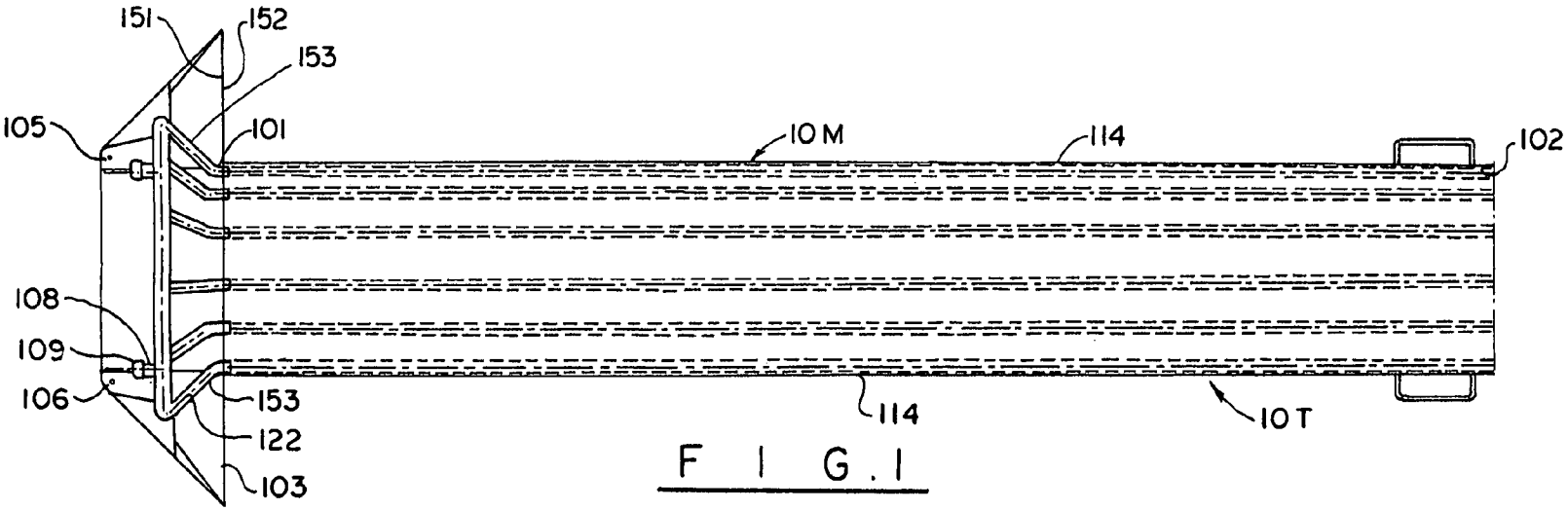
FIG. 1 is an elevational view of the preferred embodiment of the apparatus of the present invention.
Figure 3:
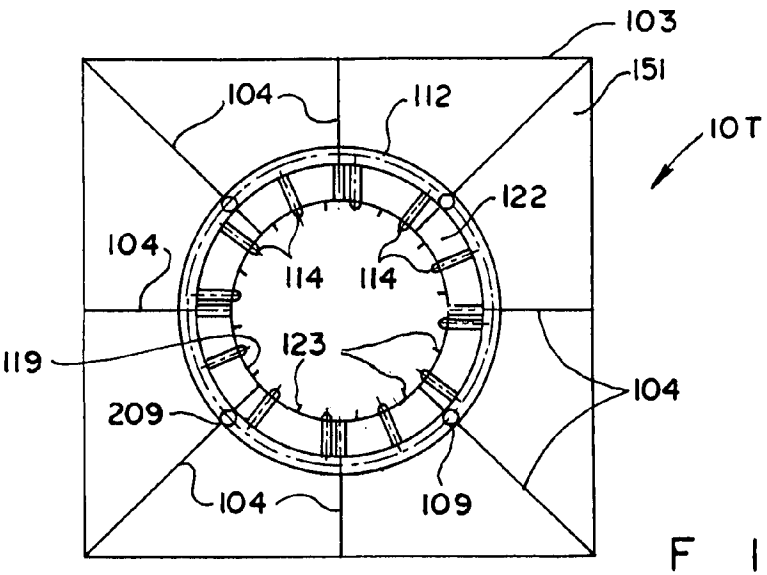
FIG. 3 is a top end view of the preferred embodiment of the apparatus of the present invention.
Figure 2:
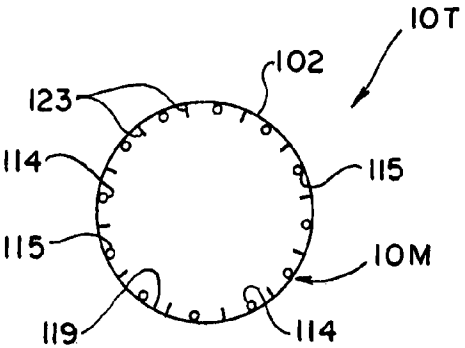
FIG. 2 is a bottom end view of the preferred embodiment of the apparatus of the present invention.

As can be seen in FIG. 1, the tool 10T of the preferred embodiment of the present invention, includes a generally cylindrical main body 10M configured of sufficient diameter to envelope a conductor pipe which is to be cut, the main body 10M having a first, upper end 101 and a second, lower end 102. The first end comprises a base plate 103 having an upper side 151 and a lower side 152. Affixed to the upper side 151 are gussets 104. Also, there are lift eyes 105, 106, and a bell 122 reinforced by the inner edge 153 of each gusset.

The first end 101 of the main body 10M further includes intake tube 108 having an intake coupling 109, with the intake tube 108 communicating with a jet feeder ring 112 which in turn feeds spaced jet pipes 114. The jet pipes 114 feeder run along the interior wall 119 of the main to the second end 102.

Formed in the end of jet pipes 114 are jet openings 115 for releasing pressurized water or the like for excavating soil from about the periphery of the second end 102 of the tool 10T when the tool communicates with the soil in a generally transverse manner.

There is a circulation cavity between the interior wall 119 of the tool 10T and the exterior wall of the conductor pipe, wherein there is released jetted fluid. Longitudinally affixed along the interior wall 119 of tool 10T are centralizer spacer bars 123 for maintaining uniform spacing between the tool 10T and the conductor pipe, as the tool 10T slidingly envelopes the pipe longitudinally.

The present invention is an improvement to the device disclosed in U.S. Pat. No. 5,238,069. It differs in the following respects: (1) the jet tubes 114 run from the external supply ring 112 through the wall of the tool 10T and turn down on the inside of the tool 10T; and (2) the supply ring 112 is also outfitted with air supply connections 209 that allow for injecting air through the jet pipes 114 to create a vacuum to pull the oxygen through the cut and up the annulus.

Figure 4:
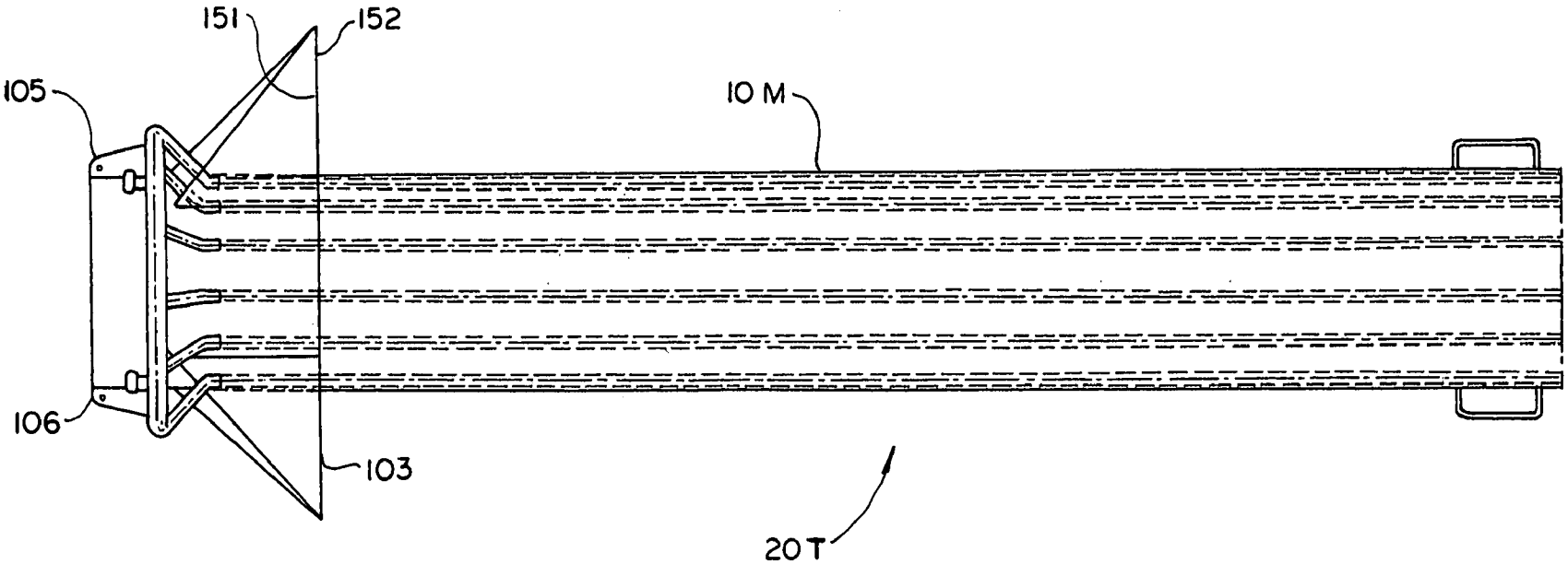
FIG. 4 is an elevational view of an alternative embodiment of the apparatus of the present invention.

Tool 20T, shown in FIG. 4, is similar to tool 10T, but the base plate 103 is closer to the bottom of main body 10M (19 feet from the bottom 102, instead of 20.5 feet from the bottom 102).

Recent experience with the invention has caused the inventor to invent another embodiment which is similar to the invention shown in the drawings, but with a shorter distance from the mudline base plate 103 to the top (preferably just about 19 inches above the plate) and about 19' 6" below the plate.

For more information about how to use the present invention, see U.S. Pat. No. 5,238,069.

All measurements disclosed herein are at standard temperature and pressure, at sea level on Earth, unless indicated otherwise.

The foregoing embodiments are presented by way of example only; the scope of the present invention is to be limited only by the following claims.

What is claimed is:

1. Apparatus for cutting pipes underwater comprising:

a jacket;

an external supply ring;

means for jetting the jacket down over the pipe;

means for blowing mud out from between the pipe and the jacket so the annulus between the pipe and the jacket can be substantially filled with water and/or air, wherein the jacket includes jet tubes running from the external supply ring through the wall of the jacket and turn down on the inside of the jacket.

2. Apparatus for cutting pipes underwater comprising:

a jacket;

means for jetting the jacket down over the pipe;

means for blowing mud out from between the pipe and the jacket so the annulus between the pipe and the jacket can be substantially filled with water and/or air, wherein the jacket includes jet pipes and a supply ring outfitted with air supply connections that allow for injecting air through the jet pipes to create a vacuum to pull the oxygen through the cut and up the annulus.

3. A method of cutting pipes underwater comprising jetting a jacket of any prior claim down over the pipe, blowing mud out from between the pipe and the jacket so the annulus between the pipe and the jacket is substantially filled with water and/or air, and performing the cutting operation from within the pipe.

* * * * *